US005919348A

United States Patent [19]

Friedrich et al.

[11] Patent Number: 5,919,348

[45] Date of Patent: Jul. 6, 1999

[54] MODIFICATION OF THE FLOW RESISTANCE OF DIAPHRAGMS

[75] Inventors: Holger Friedrich, Bobenheim-Roxheim; Klaus-Dieter Hoppe, Wachenheim; Bernd Leutner, Frankenthal; Dieter Schläfer, Ludwigshafen; Kurt Hecky, Zeiskam, all of Germany

[73] Assignee: BASF Aktiengesellschaft, Ludwigshafen, Germany

[21] Appl. No.: 08/982,441

[22] Filed: Dec. 2, 1997

[30] Foreign Application Priority Data

Dec. 4, 1996 [DE] Germany ..... 196 50 3167

[51] Int. Cl.[6] ..... C25B 1/46; C25B 13/08

[52] U.S. Cl. ..... 205/350; 205/512; 205/689

[58] Field of Search ..... 205/350, 512, 205/689; 204/295, 296

[56] References Cited

U.S. PATENT DOCUMENTS

| | | | |
|---|---|---|---|
| 4,367,270 | 1/1983 | Höhne | 427/58 X |
| 4,666,573 | 5/1987 | Dubois et al. | 205/512 |
| 4,680,101 | 7/1987 | Darlington | 204/295 |
| 5,188,712 | 2/1993 | Dilmore et al. | 205/524 |
| 5,266,350 | 11/1993 | Grob et al. | 427/140 |
| 5,470,449 | 11/1995 | Bachot et al. | 204/252 |
| 5,547,550 | 8/1996 | Kuntzburger et al. | 427/243 X |
| 5,567,298 | 10/1996 | Dubois et al. | 205/350 |

FOREIGN PATENT DOCUMENTS

| | | |
|---|---|---|
| 195 00 871 | 1/1995 | Germany . |
| 93/06217 | 8/1993 | WIPO . |
| 97/05300 | 2/1997 | WIPO . |

*Primary Examiner*—Donald R. Valentine
*Attorney, Agent, or Firm*—Keil & Weinkauf

[57] ABSTRACT

The flow resistance of a diaphragm based on a fiber material is modified by treating the diaphragm during or after preparation thereof with a dispersion comprising a fluorine-containing component and optionally with a solution comprising a precursor of $ZrO_2$.

8 Claims, 2 Drawing Sheets

MODIFICATION OF THE FLOW RESISTANCE OF DIAPHRAGMS

The present invention relates to a method of modifying the flow resistance of diaphragms, in particular of polymer diaphragms from chlor-alkali electrolysis.

The quality of a diaphragm is determined by the resistance to flow through it and thus by the rate at which the brine in the cell can flow through the diaphragm. The higher the flow resistance of the diaphragm, the less brine flows per unit time through the diaphragm and the higher, for the example of chlor-alkali electrolysis, the concentration of the sodium hydroxide obtained. On the other hand, the concentration must not become too high, since the sodium hydroxide can otherwise crystallize out and this can result in technical difficulties in the process. In the case of chlor-alkali electrolysis, a concentration of about 12–13% by weight is regarded is optimum.

Particularly in the case of recycled or reprocessed diaphragms, the recovered diaphragms may have a different flow resistance than the original diaphragms. The flow resistance of these recycled or reprocessed diaphragms can be, in particular, lower than that of the original diaphragms. This means that the sodium chloride solution which is pushed at a defined pressure from the anode compartment to the cathode compartment during electrolysis frequently runs through the diaphragm more quickly in the case of diaphragms made of recycled material than in the case of diaphragms made of original material. In chlor-alkali electrolysis, this results in a much diluted alkali solution which later has to be concentrated with additional use of both equipment and energy. The performance of such a recycled or reprocessed diaphragm is thus poorer than that of the original diaphragm. Even in the case of original polymer diaphragms the flow resistance is lower than, for example, for asbestos diaphragms. The polymer diaphragms can therefore not replace the asbestos diaphragms without restriction.

DE-A-195 00 871 describes a method of recycling, in particular, polymer diaphragms in which the fibrils or fibers of the original diaphragms have both a reduced diameter and a reduced length after recycling. The recycled fibers give diaphragms whose permeability is greater than that of original diaphragms. It has therefore been proposed that a zirconium oxide having a particular particle size distribution be mixed into the slurry when depositing the diaphragms. However, this leads to only partial sealing of the recycled diaphragms.

DE-C-36 29 820 describes a method of producing an asbsetos-free original diaphragm in which organic polymer fibers, fibrils or filaments bearing functional groups are mixed in in order to aid the desired permeability properties of the diaphragm. This increases the permeability of the diaphragm.

DE-C-41 43 172 describes a process for preparing chlorine and alkali metal hydroxide. To achieve the desired permeability of the diaphragm and the desired power efficiency, a sufficient amount of mineral clay is added.

DE-A-41 43 173 describes a liquid-permeable diaphragm for chlor-alkali electrolysis cells which is produced from fiber material and has at least one covering layer of particulate, inorganic, refractory material deposited on the anode side and bound by means of cement. Particulate zirconium oxide can be additionally present in the voids within the fiber matrix of the diaphragm.

EP-B-0 412 917 describes a polymer diaphragm and its production and also combining such a diaphragm with a cathode element.

WO relates to a process for reducing the permeability of a diaphragm, wherein an amphoteric material like an aluminium compound that is soluble in an anolyte is added to the anolyte of a chlor-alkali diaphragm cell when starting the cell. Furthermore, nonamphoteric inorganic materials which change the permeability of the diaphragm can be added. Examples of these compounds are magnesium compounds, zirconium compounds, clays and mixtures thereof.

U.S. Pat. No. 4,680,101 describes that a polymeric metal oxide like polytitanic acid, polyzirconic acid or polysilicic acid can be deposited on a diaphragm for affecting the permeability. The addition can be performed in the working electrolytic cell.

WO 93/16217 disclosed diaphragms for electrolytic cells and processes for producing them. PTFE fibers, a PTFE dispersion and talc are deposited on a lattice structure to obtain a diaphragm after drying and sintering.

It is an object of the present invention to provide a more economical and more reliable method of modifying the flow resistance of diaphragms, in particular of recycled polymer diaphragms from chlor-alkali electrolysis. A further object is to provide a thus recycled, diaphragm.

The object is achieved by a method of modifying the flow resistance of a diaphragm based on a fiber material, wherein during or after preparation of the diaphragm the diaphragm is treated with a fluorine-containing dispersion, or a dispersion comprising a fluorine-containing component, and optionally a solution comprising a precursor of $ZrO_2$. The treatment can be carried out, for example, by dipping or by allowing an aqueous solution which comprises the dispersion comprising a fluorine-containing component to flow through the diaphragm before switching on the power (for electrolysis), with the solution flowing through the diaphragm from the anode side to the cathode side. In this way, the preferably recycled diaphragm can be sealed and the flow resistance of the diaphragm can thus be increased. This is surprising in so far as the mean pore diameter in the diaphragm of recycled fibers (determined using mercury porosimetry in accordance with DIN 66133) is more than 1 $\mu$m, often even from 6 to 20 $\mu$m, and it was therefore to be assumed that the dispersed particles of a fluorine-containing dispersion would flow through the diaphragm. This enables the flow resistance both of the original diaphragm and, particularly preferably, the recycled diaphragm to be set more precisely, in particular increased. The precursor of $ZrO_2$ can be, in particular, $ZrOCl_2$, $Zr(OR)_4$, where R is an $C_{1-12}$-alkyl radical, and/or $ZrCl_4$.

A further preferred embodiment of the invention provides a method in which the dispersion comprising a fluorine-containing component is added during production of the recycled diaphragm from fibers, in particular to the slurry. In the production of recycled diaphragms, for example, the comminuted and washed fibers are processed further to form a slurry from which diaphragms are produced, preferably by vacuum deposition. The slurry is preferably an aqueous slurry of the fibers which can further comprise a thickener, sodium chloride, sodium hydroxide, bactericides, various surfactants and antifoams. The fluorine-containing dispersion is preferably added to this slurry while stirring. The diaphragms obtained by vacuum deposition have a significantly reduced permeability compared with diaphragms which are produced without a fluorine-containing dispersion.

In a further embodiment of the method of the present invention, the treatment of the diaphragm is carried out during electrolysis, preferably in a chlor-alkali-electrolysis. This makes it possible to modify the flow resistance of a diaphragm without it having to be recycled, ie. removed from the cell, comminuted, washed, slurried and redeposited. The flow resistances of reprocessed diaphragms can thus also be adjusted in situ. Particularly preferably, it is also possible for the flow resistance of a diaphragm which has already been treated with a fluorine-containing dispersion during its production or during the recycling step to be adjusted subsequently, in particular during electrolysis, and in this way to set it more precisely afterwards. For this purpose, the dispersion is preferably diluted with an aqueous medium and the resulting dispersion or the zirconium-containing solution is placed on the diaphragm so that it can, for example, run through slowly. Particular preference is given to treating the diaphragm with the dispersion or the zirconium-containing solution during electrolysis, with the dispersion or solution being added to the brine feed to the cell or being added to the anolyte. The brine which has been treated in this way is preferably pushed through the diaphragm during the electrolysis, with the rate of flow through the diaphragm being able to be adjusted, preferably reduced, to the desired value within a short time, ie. a few minutes to a number of hours.

The fluorine-containing component present in the dispersion is preferably a fluoropolymer i.e. an organic fluorine containing polymer, like particularly preferably PVDF (polyvinylidene difluoride), PFA (perfluor alkoxy polymers) or polychlorotrifluoroethylene, most particularly preferably PTFE (polytetra-fluorethylene). The dispersion is particularly preferably an aqueous dispersion and preferably has a solids concentration of from 20 to 80% by weight, particularly preferably from 50 to 70% by weight. In the case of the PTFE dispersion, this solids content is the PTFE content.

In a further preferred embodiment of the method of the present invention, the solids of the fluorine-containing component of the dispersion have a size distribution with maxima in the range from 0.1 to 0.5 $\mu$m, preferably 0.15 to 0.4 $\mu$m, particularly preferably from 0.2 to 0.3 $\mu$m. Dispersions containing solid particles of such a diameter did so far not appear suitable for sealing mean pore diameters of the recycled diaphragms in the range from 6 to 20 $\mu$m. It was to be assumed that these dispersed particles would run through the diaphragm. It was, however, found that these dispersions can be employed. The pore diameter distribution in the original diaphragm can have maxima at from 0.2 to 0.5 $\mu$m and a smaller maximum at from 8 to 20 $\mu$m. Although diaphragms of recycled material can also have a pore diameter maximum at from 0.2 to 0.5 $\mu$m, such a diaphragm mostly has a pore diameter distribution with two maxima, for example at from 10 to 40 $\mu$m and at from 100 to 300 $\mu$m. These larger pores are considered mostly responsible for the greater permeability of diaphragms of recycled material in comparison with the original diaphragms. It was found that the diaphragm can be sealed by means of particles having a diameter of less than 1 $\mu$m.

In a further preferred embodiment of the method of the present invention, the dispersion is diluted with an aqueous solution, preferably sodium chloride solution, before use. This makes it possible to match the percolation and mixing behavior of the dispersion to the circumstances of the diaphragm to be treated.

In a further preferred variant of the method of the present invention, the dispersion contains from 0.1 to 10% by weight, preferably from 3 to 6% by weight, of a preferably nonionic surfactant. The surfactant enables the stability of the dispersion to be adjusted. The diaphragm can likewise be treated (again) with a surfactant in an additional step in order to again adjust the surface behavior of the diaphragm. In addition, the wettability can be increased by this means.

In a further preferred embodiment of the method of the present invention, the dispersion has a pH of from 4 to 11, particularly preferably from 8 to 10.

If the dispersion is used during the production of the diaphragm, the amount of solid present in the dispersion used, in particular the amount of PTFE used, is, in a particularly preferred embodiment, from 0.1 to 30% by weight, preferably from 0.5 to 10% by weight and particularly preferably from 3 to 7% by weight, based on the fiber material of the diaphragm. These percentage figures are based on the weight of pure solid or PTFE per weight of fiber.

If the finished diaphragm is treated for the first time or again with the dispersion, the amount of solid present in the dispersion used, in particular the amount of PTFE used, is, in a particularly preferred embodiment of the invention, from 30 to 500 g/m$^2$ of diaphragm area, preferably from 50 to 300 g/m$^2$, particularly preferably from 100 to 200 g/m$^2$.

Another object of the present invention is achieved, in particular, by a diaphragm which has been produced or treated by means of the method of the present invention.

The following examples illustrate the invention and describe and explain further advantageous embodiments of the invention.

The figures show graphs from the examples, viz.

FIG. 1 shows the flux D (in 1/m$^2$ h) of a brine (300 g/l NaCl) through a diaphragm before and after the treatment with 60% PTFE-dispersion vs. time Z (in hours). At the times indicated by the arrows 42 g/m$^2$ PTFE-dispersion were added each.

FIG. 2 shows the flux D (in 1/m$^2$ h) of a brine (300 g/l NACl) throug a recycling diaphragm vs. time Z (in hours). At the times indicated by the arrows two times 42 g/m$^2$ each and afterwards two times 84 g/m$^2$ each of PTFE-dispersion were added.

EXAMPLE 1

Figure 1:
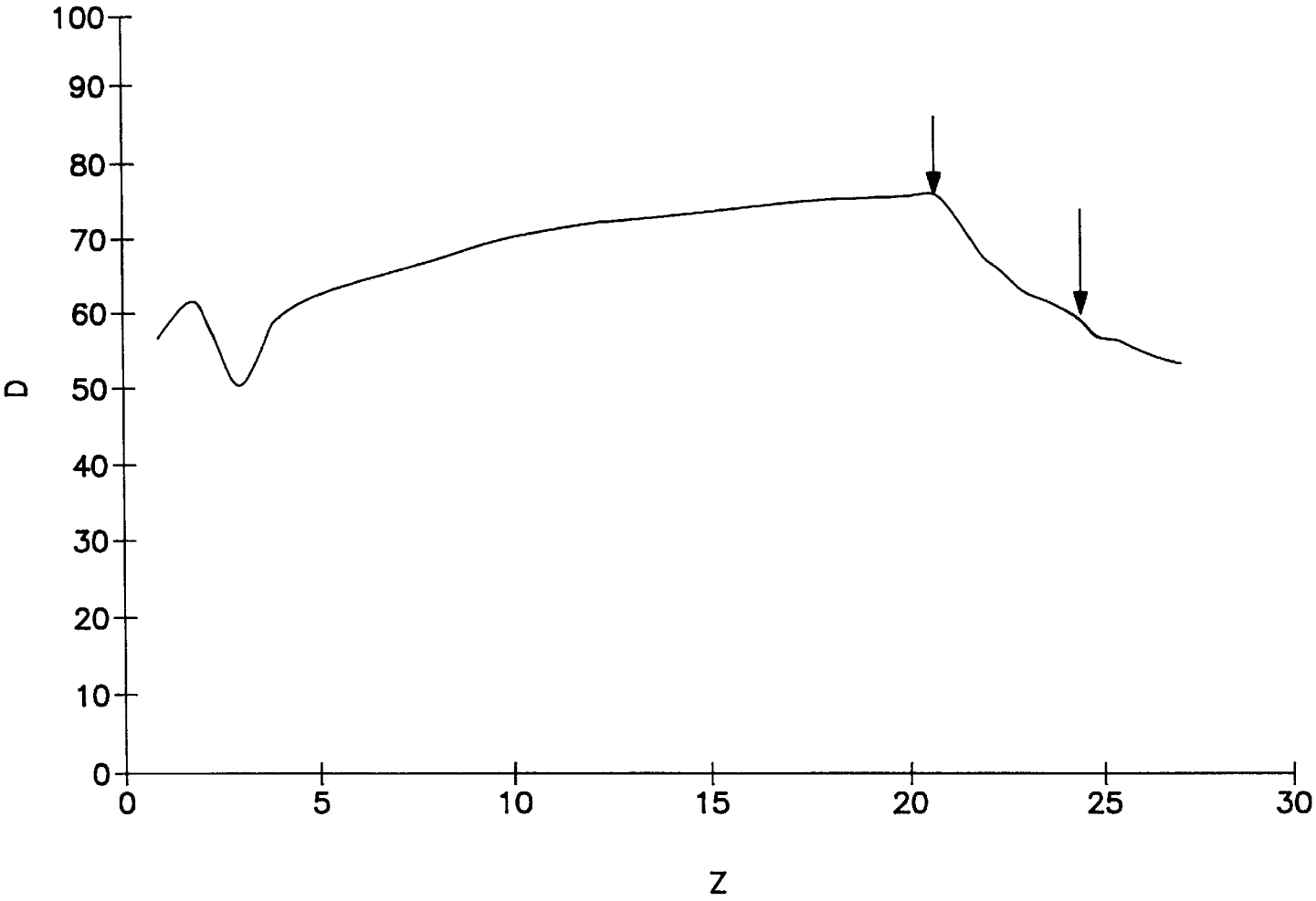
FIG. 1 shows the flux vs. time curve for Example 3.

Production of diaphragms using recycled fibers with addition of PTFE dispersion to the fiber slurry Diaphragms are produced using a moist fiber material having a solids content of 76.2% and obtained as described in DE-A-195 00 871. The slurry solution likewise used is obtained by admixing 12.5 kg of water with 26.25 g of thickener based on a polysaccharide, 26.25 g of Proxel® GXL (ICI, bactericide containing 1,2-benzisothiazolin-3-one as active ingredient) and 3.1 g of the silicone antifoam DC10010A (product of Dow Corning) and homogenizing using an Ultraturfax.

The slurry is obtained by vigorously stirring 434 g of slurry solution, 1 of Zonyl® FSN (DuPont, nonionic fluorinated surfactant), 34.4 g of NaCl and 37 g of recycled fibers for 15 minutes and adjusting the pH to 11.3 using 50% strength NaOH.

Subsequently, a previously prepared suspension of 5 g of $ZrO_2$CF Super HM® (unstabilized $ZrO_2$ having about 10% of the particles<5 $\mu$m, about 50% of the particles<1.1 $\mu$m, about 90% of the particles<3.9 $\mu$m; trade name of Z-tech)

3 g of PTFE dispersion, 60% strength, Hostaflon TFX 5050 (60% strength PTFE dispersion containing about 5% of a nonionic wetting agent and having a pH of 9 and a particle size distribution with a maximum at about 0.2 μm; trade name of Hoechst)

in 15 g of deionized water is added while stirring.

The fiber slurry is calculated for a circular test diaphragm having an area of 75 $cm^2$ (d=9.8 cm.) An expanded metal cathode mesh made of iron together with a superposed fine nylon mesh are clamped in place in a small deposition apparatus. Subsequently, the above-described homogenized fiber slurry is poured on and allowed to run through the nylon mesh for 30 minutes without application of a vacuum. The amount of slurry solution which runs through is 170–210 ml. A vacuum is subsequently applied to the deposition apparatus by means of a diaphragm pump.

| Time in min | Pressure in mbar |
|---|---|
| 0 | atmospheric |
| 1 | 980 |
| 5 | 940 |
| 9 | 850 |
| 13 | 850 |
| 17 | 740 |
| 20 | 640 |
| 25 | 530 |
| 30 | 500 |
| 35 | 200 |
| 40 | 200 |

When all the slurry solution has been sucked through, the diaphragm remains under suction for a further 90 minutes. After about 140 minutes, the pressure on the suction side is about 310 mbar. The diaphragm thus obtained was treated as follows:

drying the deposited diaphragm for 6 hours at 95° C.

heating from 95° C. to 320° C. in about 1.5 hours holding the temperature at 320° C. for 1.5 hours heating from 320° C. to 360° C. in 1 hour cooling in a closed, switched-off oven.

The diaphragm was subsequently treated with a 4% strength Zonyl solution for 30 minutes. To measure the permeability, a constant 22 cm liquid column of sodium chloride solution (300 g/l) was placed on the diaphragm. The flow of the brine through the diaphragm was 16 $l/m^2h$ after 1 hour and 23 $l/m^2h$ after 10 hours.

EXAMPLE 2

A test diaphragm was produced using a method similar to Example 1 and the flow through it was determined. However, as a change from Example 1, only 1 g of PTFE dispersion was used.

EXAMPLE 3

A test diaphragm was produced using a method similar to Example 1 and the flow through it was determined. No PTFE dispersion was used in preparing the fiber slurry, but instead the diaphragm was treated afterwards with PTFE dispersion. For this purpose, 2×42 g of PTFE dispersion Hostaflon® TFX 5050 per $m^2$ were added to the brine feed during the measurement on the test diaphragm. The diaphragm, which gave a flux of about 85 $l/h*m^2$ before treatment, had a permeability of about 55 $l/h*m^2$ after treatment.

This test run is shown in FIG. 1. The X axis gives the time and the Y axis gives the flux. It can be clearly seen that the permeability decreases on addition of the PTFE dispersion.

EXAMPLE 4

A diaphragm produced as described in Example 3 and treated with a total of 252 $g/m^2$ of PTFE dispersion had a permeability of about 60 $l/h*m^2$ before treatment and about 28 $l/h*m^2$ after treatment.

Figure 2:
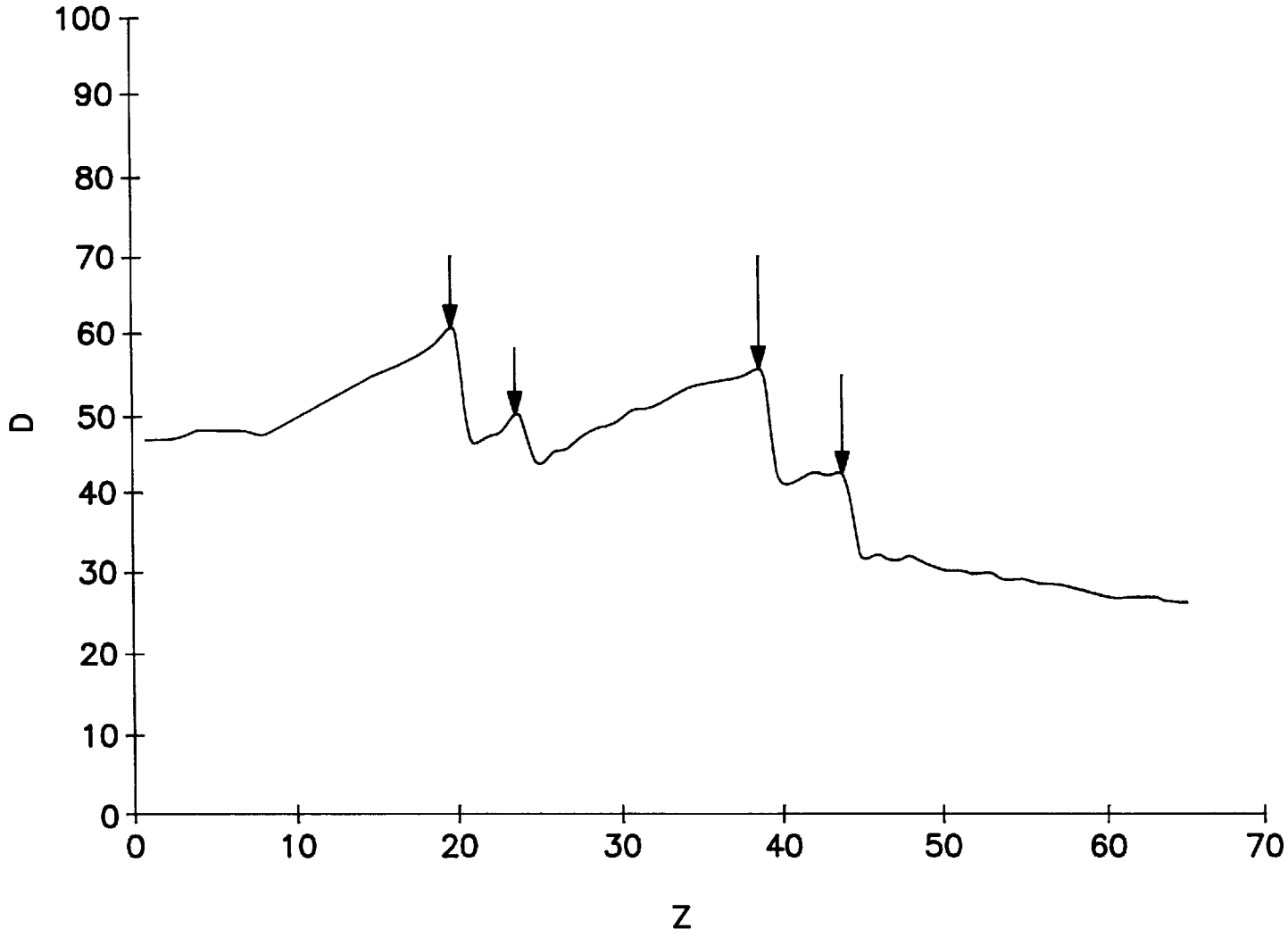
FIG. 2 shows the flux vs. time curve for Example 4.

This test run is shown in FIG. 2. The test run of FIG. 1 was continued and here too it can be clearly seen that further addition of PTFE dispersion enabled the flow resistance to be increased further. Although the flow resistance dropped again after each of the first three additions of PTFE dispersion, the flow resistance remains at a high level after the last addition and even increases further with time.

EXAMPLE 5

Using a method similar to Example 1, an electrolysis cell from De Nora having an electrode area of 700 $cm^2$ was coated with a diaphragm. For this purpose, the amounts of coating material used were increased in proportion to the electrode area. After commencement of electrolysis, the flow of brine through the cell was 5.5 l/h. After treatment with 2×15 g of PTFE dispersion Hostaflon® TFX 5050, the flow was reduced to 3.8 l/h.

The method according to the invention for modifying the flow resistance of a diaphragm is more economical and more reliable than known processes. It enables the flow resistance to be set to a desired range even after production of the diaphragm.

We claim:

1. A method of modifying the flow resistance of a diaphragm, based on a fiber material which comprises treating the diaphragm during or after preparation thereof with a dispersion comprising a fluoropolymer which is present in the dispersion as a solid having a size distribution with maxima in the range from 0.1 to 0.5 μm and optionally with a solution comprising a precursor of $ZrO_2$.

2. A method as claimed in claim 1, wherein the diaphragm is treated during electrolysis.

3. A method as claimed in claim 1, wherein the dispersion is an aqueous dispersion and the fluorine-containing component is present in the dispersion in a solids concentration of from 20 to 80% by weight.

4. A method as claimed in claim 1, wherein the dispersion is diluted with an aqueous solution chloride solution, prior to treating the diaphragm.

5. A method as claimed in claim 1, wherein the dispersion contains from 0.1 to 10% by weight of a surfactant.

6. A method as claimed in claim 1, wherein the diaphragm based on a fiber material is a polymer diaphragm for chlor-alkali electrolysis.

7. A method as claimed in claim 1, wherein the amount of fluoropolymer contained within the dispersion is from 0.1 to 30% by weight based on the fiber material of the diaphragm.

8. A method as claimed in claim 1, wherein the amount of fluoropolymer used in the dispersion, is from 30 to 500 $g/m^2$ of diaphragm area.

* * * * *